US007350644B2

(12) United States Patent
Harwell et al.

(10) Patent No.: US 7,350,644 B2
(45) Date of Patent: Apr. 1, 2008

(54) MULTI-LAYER FILM PACKAGING OF HOT MELT ADHESIVE

(75) Inventors: Michael G. Harwell, Düsseldorf (DE); Dale L. Haner, Ringwood, NJ (US); Leisa A. Ryan, Windsor (GB)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 1014 days.

(21) Appl. No.: 10/274,827

(22) Filed: Oct. 21, 2002

(65) Prior Publication Data

US 2004/0074800 A1 Apr. 22, 2004

(51) Int. Cl.
*B65D 57/00* (2006.01)
*B65B 3/02* (2006.01)

(52) U.S. Cl. ..... 206/447; 53/440; 206/524.2

(58) Field of Classification Search ..... 206/447, 206/524.1, 524.2, 524.6; 53/440; 522/182
See application file for complete search history.

(56) References Cited

U.S. PATENT DOCUMENTS

| | | | | |
|---|---|---|---|---|
| 3,314,536 A | | 4/1967 | Janota et al. | |
| 5,674,944 A | | 10/1997 | Falla et al. | |
| 5,789,048 A | | 8/1998 | Flieger | |
| 5,804,610 A | * | 9/1998 | Hamer et al. | 206/447 |
| RE36,177 E | * | 4/1999 | Rouyer et al. | 53/440 |
| 5,987,852 A | * | 11/1999 | Bozich et al. | 53/440 |
| 6,044,625 A | * | 4/2000 | Waver et al. | 53/440 |
| 6,138,441 A | * | 10/2000 | Kik et al. | 53/440 |
| 6,230,890 B1 | * | 5/2001 | Waver et al. | 206/447 |

FOREIGN PATENT DOCUMENTS

| | | |
|---|---|---|
| EP | 0 699 586 | 3/1996 |
| FR | 2 544 654 | 10/1984 |
| WO | WO 99/33704 | 7/1999 |
| WO | WO 00/09401 | 2/2000 |
| WO | WO 02/061009 | 8/2002 |

* cited by examiner

*Primary Examiner*—Bryon P Gehman
(74) *Attorney, Agent, or Firm*—Cynthia L. Foulke

(57) ABSTRACT

Multi-layer films are used to package hot melt adhesives. The packaging film does not require removal prior to use of the adhesive. Multi-layer films wherein at least one layer has a melting point below about 100° C. is used to package low application temperature hot melt adhesives.

20 Claims, 1 Drawing Sheet

MULTI-LAYER FILM PACKAGING OF HOT MELT ADHESIVE

FIELD OF THE INVENTION

Figure 1:
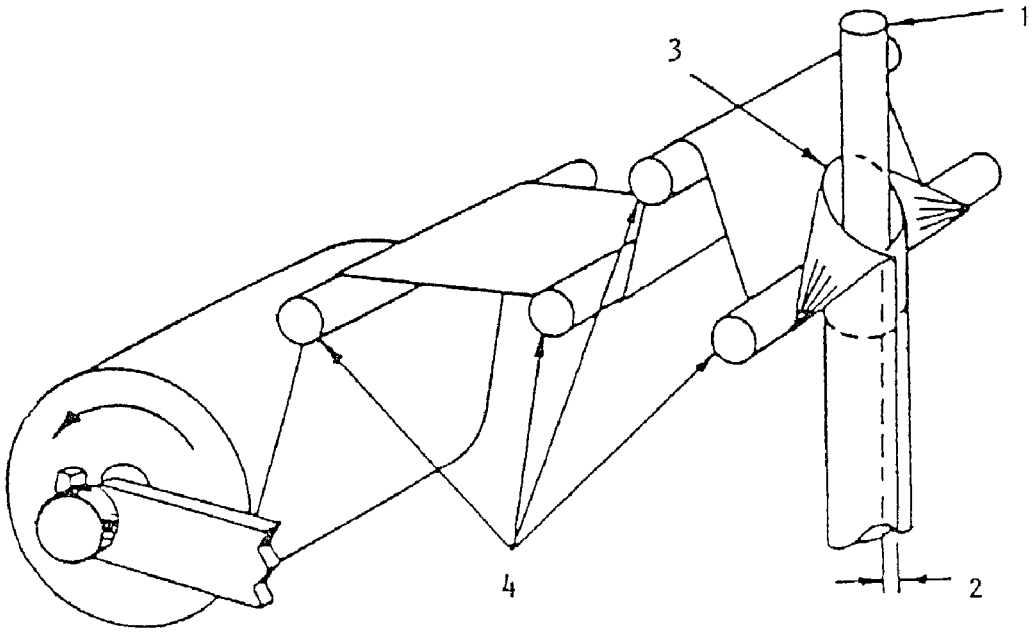

The invention relates to a method for packaging hot melt adhesive compositions and to the resulting packaged adhesive compositions.

BACKGROUND OF THE INVENTION

Hot melt adhesives, which are generally applied while in the molten or liquid state are, solid at room temperature. Typically, these adhesives are provided in the form of blocks and because of the nature of these materials, particularly the pressure sensitive hot melts, there are problems associated with handling and packaging them. The solid adhesive blocks not only stick or adhere to hands or mechanical handling devices but also to each other. They also pick up dirt and other contaminants. Additionally, certain applications which require high tack formulations result in blocks that will deform or cold flow unless supported during shipment.

The need and advantages for providing tackless or non-blocking hot melt adhesives are apparent and various ways of accomplishing this have been developed. While most of these prior art methods have provided some degree of improvement in the packaging and handling of hot melt adhesives, they have suffered by virtue of either the need to unwrap or otherwise unpackage the hot melt or, in the cases of coated hot melts which are added directly to the melting pots, by virtue of the contamination resulting from the build-up over time of large quantities of the packaging materials in the melt pot and application equipment.

Commonly assigned U.S. Pat. No. 5,373,682 significantly improved upon the state of the art by providing a packaging system and method for packaging hot melt adhesives wherein the hot melt adhesive is pumped or pored into a tube of plastic film in contact with a heat sink. When the hot melt adhesive is poured in its molten state into the plastic packaging film and then allowed to solidify, the adhesive fuses to some extent into the film, resulting in a non-blocking adhesive package which will melt faster in the melt pot and will not cause a build up of undesirable plastic residue even after extended periods of time. The intermingling of one or more of the hot melt components into the contact surface of the plastic film allows some mixing or compatibilizing of the film and the hot melt thereby improving the opportunity for more complete mixing of the hot melt and film when remelting of the packaged hot melt occurs. Such a method also provides an additional benefit over prior non-blocking packages in that the package itself is air-tight allowing no air to be entrapped therein. The presence of entrapped air has been blamed for a variety of problems including incomplete melting and blending of the packaging material into the adhesive whereby the packaging material floats on the surface of the hot melt and/or adheres to the walls of the melt pot. The resultant adhesive package provides a readily handable adhesive in cartridge form that may, advantageously, be produced in a continuous line operation.

Commonly assigned published International Application No. WO 02/061009 A2 advanced the state of the art by providing a system for the packaging of low temperature adhesives and pressure sensitive adhesives, i.e., adhesives formulated for application at temperatures below about 275° F. and down to about 150° F.

Notwithstanding the prior art packaging systems, there continues to be a need for improvements and modification of such packaging systems leading to the wider applicability thereof. The current invention provides such an improvement.

SUMMARY OF THE INVENTION

The invention provides a packaging system for hot melt adhesives, both conventional and low application hot melt adhesives.

One aspect of the invention is directed to a multi-layer film comprising at least two different thermoplastic layers. When used in the packaging of low application hot melt adhesives at least one of said layers will have a melting point below about 100° C., and preferably below about 90° C. In a preferred embodiment the film layers are copolymers of polyethylene or polypropylene with another comonomer such as vinyl acetate or methyl acrylate.

Another aspect of the invention is directed to an encapsulated or packaged hot melt adhesive wherein the adhesive is encapsulated within a multi-layer film. The encapsulating film is meltable together with the adhesive composition and blendable into the molten adhesive without deleteriously affecting the properties of the adhesive.

Another aspect of the invention is directed to a method of packaging a low temperature hot melt adhesive comprising wrapping a hot melt adhesive in a thermoplastic film, said film being a multi-layer film. When used to package a low application hot melt adhesive least one layer of the multi-player film has a melting temperature below about 100° C. In a preferred embodiment, the adhesive is in the molten state when wrapped. A particularly preferred method of the invention comprises pumping or pouring molten hot melt adhesive in liquid form into a cylindrical plastic multi-layer film, the cylindrical tube being in direct contact with a heat sink. The adhesive is poured or pumped into the cylinder at a temperature at or above the melting point of the plastic film and the plastic film is meltable together with the adhesive composition and blendable into the molten adhesive. The molten hot melt adhesive filled cylinder is then sealed and allowed to cool.

BRIEF DESCRIPTION OF THE DRAWING FIGURE

FIG. 1 shows a cylindrical plastic tube formed for receipt of molten adhesive.

DETAILED DESCRIPTION OF THE INVENTION

The invention provides a packaged hot melt adhesive and a method of encapsulating or packaging hot melt adhesive.

The term "hot melt adhesive" is used herein generically to refer to both conventional and low application temperature hot melt adhesive, unless otherwise indicated. Low temperature hot melt adhesive and low application temperature hot melt adhesive are used interchangeably herein and refer to an adhesive which can be processed at temperatures below about 275° F. to as low as about 150° F.

The terms wrapped, encapsulated and packaged are used interchangeable herein and mean that blocks of adhesives are contained within a film that protects the adhesive from contamination, allows easy handling, may be shipped and stored without blocking and which can be processed without the removal of the film.

Non-blocking means that the individually wrapped adhesive blocks do not stick together in the packing case upon storage and shipment.

Blocks, sausages, and cartridges of adhesive are used interchangeably and refer to individually wrapped adhesive portions.

One aspect of the invention is directed to an encapsulated or packaged hot melt adhesive comprising a hot melt adhesive that is encapsulated within a multi-layer film. In one embodiment at least one of the layers of the multi-layer film has a melting point below about 100° C. The encapsulating film is meltable together with the adhesive composition and blendable into the molten adhesive without deleteriously affecting the properties of the adhesive.

It has been discovered that the use of multi-layer films may advantageously be used in the packaging of hot melt adhesives. By selecting materials with dissimilar properties such as compatibility, density, crystallinity and coextruding them into a single film, superior packaging of adhesives can be achieved.

Multi-layer films may be made by the coextrusion of multiple polymer film resins into a single composite film in which the layers have distinct thermal properties, i.e., distinct melting points as opposed to a polymer blend with a single or depressed melting point.

One layer of a multi-layer film of the invention may, if desired, be present in an amount greater than any of the other layers present in the film. Likewise, one layer of a multi-layer film of the invention may be present in an amount that is less than any of the other layers of the film. Hereinafter, the component layer present in the greatest amount may alternatively be referred to as the major component, and the component layer present in the least amount may alternatively be referred to as the minor component. When used in the packaging of low application temperature hot melt adhesives, the major layer will have a melting point of below about 100° C. and the minor component will have a melting temperature greater than 100° C., more typically from about 105 to about 110° C., and will typically be used in the least amount needed for packaging quality. The major component will preferably be present in amounts greater than 50%, more typically from about 65% to about 85%.

When used in the packaging of low application hot melt adhesives, coextruding where the major component has a low melting point and the minor component has good mechanical properties and oil migration resistance is especially useful. By coextruding two different copolymers into distinct layers, defined as having separate and distinct melting points, a film can be made that significantly improves the non-blocking properties of the package while maintaining good dispersability in the melt at low application temperatures.

In the practice of the invention, hot melt adhesives may be packaged with either the major or the minor component layer being in contact with the adhesive. Exact packaging will be dictated by the adhesive formulation to be packaged and the desired properties, e.g., dispersibility requirements, non-blocking requirements, etc.

The multi-layer films of the invention may advantageously be made by conventional coextrusion as is well known in the art, using a number of extruders corresponding to the total number of layers constructing the film. For instance, a common T-die may be used for manufacturing a flat laminate film or, preferable, a common circular die may be used for manufacturing a tubular laminate film. It will be understood that the films may also me made by conventionally laminating two different films together. The terms different and distinct are used interchangeably herein and mean that one layer differs from the other in at least one property, e.g., composition, crystallinity, melting point, density and the like.

In one method of the invention a molten hot melt adhesive at from about 150° F. to about 275° F. is wrapped in a plastic multi-layer film at least one layer of which has a melting point below about 100° C., preferable below about 90° C. While the adhesive can be wrapped in the solid state, the adhesive is preferably wrapped in the molten state. Wrapping can occur either manually or, more preferably, by an automated procedure.

In a preferred method of the invention, packaging is accomplished by pumping or pouring molten hot melt adhesive in liquid form into a cylindrical thermoplastic multi-layer film, the cylindrical tube being in direct contact with a heat sink, e.g., cooled water or a cooled liquid or gaseous environment. The adhesive being poured or pumped is at a temperature at or above the melting point of the lower melting point layer of the plastic film and the plastic film is meltable together with the adhesive composition and blendable into the molten adhesive without deleteriously affecting the properties of the adhesive. The molten hot melt adhesive filled cylinder is sealed and allowed to solidify.

The thermoplastic multi-layer film into which the molten adhesive is to be poured may be any film which is meltable together with the adhesive composition and blendable into said molten adhesive and which will not deleteriously affect the properties of the adhesive composition when blended therewith.

Film melting points are as determined by DSC (differential scanning calorimetry) using a DSC 2920 from TA Instruments. In a typical procedure used to determine film melting points, about 5 mg of film are sealed in a crimped aluminum pan. The instrument first heated the sample to 160° C., then cooled the sample to +60° C., and then reheated it to 160° C. at 10° C./min for each step. The endothermic melting peak on the second heat up cycle was used to evaluate the melting point and heat of fusion. The melting point was taken as the temperature of the minimum in this endothermic melting peak (temperature of maximum heat absorption rate).

An example of a thermoplastic polymer that has a melting point above about 100° C. is Escorene LD316-19, an EVA film having a vinyl acetate content of 2%. Other thermoplastic polymers having melting points above about 100° C. are commercially available.

Preferably, when packaging a low temperature hot melt adhesive, at least one layer of the encapsulating film is a copolymer of ethylene or propylene with methyl acrylate, n-butyl acrylate, vinyl acetate or other olefins or α-olefins such as butene, hexene, octene or norbornene, ethylene copolymers with acrylic or vinyl esters, ethylene/carbon monoxide, and terpolymers. More preferred are copolymers of ethylene with methyl acrylate, n-butyl acrylate or vinyl acetate, in particular those comprising greater than 10% of the comonomer, preferably from about 10 to about 45% comonomer. Ethylene methyl acrylate and ethylene vinyl acetate are particularly preferred for use in the practice of the invention. Films which may be used to practice the invention are commercially available from ExxonMobil under the trade name Optema TC 114 (ethylene methyl acrylate comprising 18% methyl acrylate) and Escorene LD706 (ethylene vinyl acetate comprising 15.3% vinyl acetate).

The films may, if desired, contain antioxidants for enhanced stability as well as other optional components including slip agents such as erucamide, anti-blocking agents such as diatomaceous earth, fatty amides or other processing aids, anti-stats, stabilizers, plasticizers, dyes, perfumes, fillers such as talc or calcium carbonate and the like. In a preferred embodiment the film contains at least a slip agent and an antiblocking agent. Typically the film will contain about 3,000 ppm of a slip agent and about 14,000 ppm of an antiblocking agent.

The method of the present invention is adaptable to the packaging of virtually any type of hot melt adhesive composition and specifically low temperature hot melt adhesives as defined herein, in particular hot melt adhesives which are applied at a temperature of from about 250° F. to about 190° F., more preferably from about 225° F. or below. Included are hot melt adhesives prepared from polymers and copolymers of synthetic resins, rubbers, polyethylene, polypropylene, polyurethane, acrylics, vinyl acetate, ethylene vinyl acetate and polyvinyl alcohol. More specific examples include hot melt adhesives prepared from rubber polymers such as block copolymers of monovinyl aromatic hydrocarbons and a conjugated diene, e.g., styrene-butadiene, styrenebutadiene-styrene, styrene-isoprene-styrene, styrene-ethylene-butylene-styrene and styrene-ethylene propylene-styrene; ethylene-vinyl acetate polymers, other ethylene esters and copolymers, e.g., ethylene methacrylate, ethylene n-butyl acrylate and ethylene acrylic acid; polyolefins such as polyethylene and polypropylene; polyvinyl acetate and random copolymers thereof; polyacrylates; polyamides; polyesters; polyvinyl alcohols and copolymers thereof; polyurethanes; polystyrenes; polyepoxides; graft copolymers of vinyl monomer(s) and polyalkylene oxide polymers; and aldehyde containing resins such as phenol-aldehyde, urea-aldehyde, melamine-aldehyde and the like.

Most often such adhesives are formulated with tackifying resins in order to improve adhesion and introduce tack into the adhesive. Such resin include, among other materials, natural and modified rosins, polyterpene resins, phenolic modified hydrocarbon resins, coumarone-indene resins, aliphatic and aromatic petroleum hydrocarbon resins, phthalate esters and hydrogenated hydrocarbons, hydrogenated rosins and hydrogenated rosin esters.

Optional ingredients include diluents, e.g., liquid polybutene or polypropylene, petroleum waxes such as paraffin and microcrystalline waxes, polyethylene greases, hydrogenated animal, fish and vegetable fats, mineral oil and synthetic waxes as well as hydrocarbon oils such as naphthionic or paraffinic mineral oils, stabilizers, antioxidants, colorants and fillers. The selection of components and amounts as well as the preparation thereof are well known in the art and described in the literature.

The thickness of the film used to wrap the adhesive will generally vary from between about 0.1 mil to about 5 mil, preferably from about 0.5 mil to about 4 mil. The thickness of the particular film also varies depending upon the temperature at which the molten adhesive is pumped or poured into the plastic film cylinder. The particular viscosity at which the adhesive can be introduced into the plastic film cylinder will vary depending on a variety of factors including the pumping capacity of the pump, the strength of the plastic film and the like. Viscosities in the range of 1,000 to 200,000 cps, preferably 2,000 to 100,000 may be utilized, more preferably the viscosity of the adhesive which is to be packaged in accordance with the invention is between 3,000 and 25,000 cps. It will be recognized that the temperature at which an adhesive composition will exhibit this viscosity range will vary from one adhesive to another.

It is further preferred that the thermoplastic film comprise not more than about 1.5% by weight of the total adhesive mass and that it optimally vary from 0.1 to 1.0% by weight of the mass in order to prevent undue dilution of the adhesive properties.

The packaging method of the invention may itself be practiced in much the same way as described in commonly assigned U.S. Pat. No, 5,373,682, the disclosure of which is incorporated herein in its entirety by reference. Basically, and as shown in drawing FIG. 1 wherein the roll of film is loaded to unroll in the direction shown by the arrow and the film is threaded through the idler rollers (4) and over the film folder (3), a continuous supported cylindrical tube is formed by wrapping the plastic film around an, e.g., 1.5 inch diameter, insulated mandrel (1) or fill pipe. After the lap seam (2) is formed, it is sealed using hot air and then set by spraying with ambient temperature air. The molten hot melt adhesive is pumped therein through a nozzle while the entire surface of the film is sprayed with chilled water (5° C. to 10° C.). The filled tubes are voided at a desired length, e.g., 6 inches, and then cut to form individual cartridges. The resulting cartridges are allowed to cool in a chilled water bath until they have completely solidified and can be packaged in appropriate shipping containers.

The heat sink that is used in the method disclosed and claimed in commonly assigned U.S. Pat. No. 5,373,682 may also be used in the practice of the invention described herein. The heat sink comprises any means which will effectively and rapidly remove or absorb the excess heat from the entire surface of the film which is in contact with the molten hot melt adhesive composition so as to prevent the temperature of the film from exceeding its melting point even though the molten hot melt adhesive temperature is higher than the film melting temperature. Suitable heat sinks are provided by spraying the surface of the cylindrical plastic tube with cooled water or other refrigerant means such as chilled glycol, liquid or gaseous nitrogen, compressed carbon dioxide or the like. The spraying may be accomplished, for example, using a series of spray nozzles aimed at the mandrel or a water or cooling ring or series of rings may be positioned around the mandrel so as to provide a curtain or cascade of water or refrigerant around the entire circumference of the cylinder.

As discussed above, the molten adhesive is generally poured or pumped into the plastic multi-layer film cylinder at a temperature at which the molten adhesive exhibits a viscosity of 1,000 to 200,000, preferably 3,000 to 25,000 cps. This temperature will generally vary depending upon the particular adhesive. After filling, the adhesive cartridges, either individually or in a connected series, are further cooled to ambient temperature prior to bulk packaging. Cooling to room temperature may be accomplished entirely under ambient conditions, in a chilled air environment or may be hastened by submersion of the cartridges into a bath of cooled water, glycol, liquid nitrogen or the like.

Since the adhesive is pumped or poured continuously through the mandrel into the plastic multi-layer film cylinder, it is possible to void and then cut the continuous filled tube into individual cartridges at virtually any desired length. In general, the individual cartridges are produced in a variety of sizes ranging from about 3 inches to about 18 inches or more in length and varying in weight, depending upon length, from about 0.5 to five pounds.

The resultant individually packaged hot melt adhesive cartridges can be stored, handled and used without any problems of the individual blocks sticking together, adhering to other objects, or becoming contaminated even if exposed to increased pressure and/or temperature.

When it is desired to ultimately utilize the adhesive, the entire wrapped cartridge is added to the melt pot. An advantage of a preferred embodiment of the method of the invention is the fact that the adhesive is poured or pumped into the plastic film cylinder in its molten form creates some degree of fusion between the adhesive and the film. Because of this fusion, very little additional energy is required to melt and blend the film into the adhesive itself. Further, the absence of any entrapped air results in a homogeneous melting of the adhesive with no plastic film undesirably separating from the wrapped adhesive and floating to the surface and/or sides of the melting pot.

This strong interface or interphase between the adhesive and film which is formed by virtue of the melt-filling process also helps prevent the packaging film from floating or sinking in the hot melt pot due to a difference in density between the film and the adhesive or entrapped air at the interface.

The thus packaged hot melt adhesive cartridge may, of course, additionally be packaged in a second outer container to further reduce its exposure to the environment, moisture or other contaminants. The secondary wrappings would then be removed by conventional procedures prior to utilization of the hot melt adhesive.

The following examples are presented for purpose of illustration and not limitation.

EXAMPLES

In the examples, the tests used to evaluate properties were conducted as follows.

DSC (Differential Scanning Calorimeter)

Using a TA Instruments DSC 2920 or similar equipment a sample of adhesive between 5 and 10 mg in weight was prepared. The sample was loaded into the DSC with a blank pan as a reference and brought to a temperature of 25° C. The sample was heated to 177° C. at 20° C./min. and held at 177° C. for 3 minutes. The sample was then cooled to 25° C. at 20° C./min. The temperature of the peak(s) on the melting curve was measured and the value recorded.

Residual Tack

Hand wrapped cavity packs were placed in an oven at 130° F. (54° C.) for 1 week after which the surface of the blocks were evaluated for tackiness, Meltdown Approximately 100 g pieces of adhesive were placed in glass jars with 0.5% by weight of each film in an oven at 110° C. Adhesive was then gently stirred and evaluated for film dispersion and appearance.

Example 1

A rubber-based pressure sensitive hot melt adhesive suitable for applying at low temperature (190°-250° F.) was prepared using conventional mixing equipment. The adhesive had a softening point of 145° F. and a melt viscosity of about 6,000 cps at 225° F.

Continuous supported cylindrical tubes were formed by wrapping the plastic multi-layer films shown in Table 1 around a 1.5 inch diameter insulated mandrel or fill pipe. After the lap seam was formed, it was sealed using hot air and then set by spraying with ambient temperature air. In both Sample 1 and Sample 2, layer 2 was present as the major component.

TABLE 1

| Film | Composition | DCS Tm (° C.) |
|---|---|---|
| Sample 1 | Layer 1-EVA | 108.5 |
| | Layer 2-EMA | 85.4 |
| Sample 2 | Layer 1-EVA | 108.8 |
| | Layer 2-EMA | 85.2 |
| | Layer 3-EVA | 108.8 |

The molten hot melt adhesive, at a viscosity of 6,000 cps (107° C.) was pumped therein through a nozzle while the entire surface of the film was sprayed with chilled water (5-10° C.). The filled tubes were voided at lengths of 12 inches and then cut to form individual cartridges. The resultant cartridges were allowed to cool in a chilled water bath until they had completely solidified and could be packaged in appropriate shipping containers.

The resultant cartridges had a film add-on content of about 0.31% and were characterized in that the plastic wrapping film was fused into the hot melt adhesive composition and, except for the area of the lap seam, could not be physically separated therefrom. Packaging results are shown in Table 2.

Example 2

A 25 kg box of the blocks of adhesive packaged as described in Example 1 was melted down in an ITW Dynatech hotmelt tank at 105° C. The adhesive was then pumped and sprayed from a standard hotmelt spray applicator. The quality of the spray application was assessed over 8 hours of operation. The adhesive was then left at application temperature in the tank overnight and assessed for film dispersion. Results are shown in Table 2.

Example 3

1 kg blocks of the adhesive used in Example 1 were packaged in 10.5×12 inch widths of pieces each multi-layer film in the molten state. A 25 kg cardboard box full of 25 blocks of test group were aged at 45° C. for 72 hours and assessed for blocking performance. Results are shown in Table 2.

TABLE 2

| Film | Packaging | Residual tack | Blocking | Meltdown | Sprayability |
|---|---|---|---|---|---|
| Sample 1 | Easy | Very light | Minimal | Dispersed | Good |
| Sample 2 | Easy | Very light | Minimal | Dispersed | Good |

Many modifications and variations of this invention can be made without departing from its spirit and scope, as will be apparent to those skilled in the art. The specific embodiments described herein are offered by way of example only, and the invention is to be limited only by the terms of the appended claims, along with the full scope of equivalents to which such claims are entitled.

The invention claimed is:

1. A packaged hot melt adhesive comprising a hot melt adhesive encased in a thermoplastic film, said film being a multi-layer film comprising at least two thermoplastic layers which have different melting points, wherein one layer of said at least two layers comprises more than 50% of the film.

2. The packaged hot melt adhesive of claim 1 wherein said one layer of said multi-layer film has a melting point of below 100° C. and at least one other layer has a melting point above 100° C.

3. The packaged hot melt adhesive of claim 2 wherein the multi-layer film comprises two layers.

4. The packaged hot melt adhesive of claim 2 wherein the multi-layer film comprises three layers.

5. The packaged hot melt adhesive of claim 2 wherein said one layer has a melting point of below about 90° C.

6. The packaged hot melt adhesive of claim 2 wherein said one layer comprises from about 65% to about 85% of the film.

7. The packaged hot melt adhesive of claim 2 wherein at least one layer of said multi-layer film comprises a copolymer of ethylene or propylene with another comonomer.

8. The packaged hot melt adhesive of claim 7 wherein at least one layer of said multi-layer film comprises a copolymer of ethylene with from about 10% to about 45% methyl acrylate, n-butyl acrylate or vinyl acetate comonomers.

9. The packaged hot melt adhesive of claim 2 wherein said one layer of said multi-layer film comprises ethylene methyl acrylate.

10. The packaged hot melt adhesive of claim 9 wherein said at least one other layer of said multi-layered film comprises ethylene vinyl acetate.

11. The packaged hot melt adhesive of claim 2 wherein the hot melt adhesive is a low application temperature hot melt adhesive.

12. A method of packaging a low temperature hot melt adhesive comprising wrapping a low temperature hot melt adhesive in a thermoplastic film, said film being a multi-layer thermoplastic film comprising at least two thermoplastic layers which have different melting points, wherein one layer of said at least two layers comprises more than 50% of the film.

13. The method of claim 12 wherein said one layer of said multi-layer film has a melting point below 100° C. and said at least one other layer of said multilayer film has a melting point above 100° C.

14. The method of claim 13 wherein the adhesive is wrapped in the molten state.

15. The method of claim 14 wherein the molten hot melt adhesive is pumped or poured into a cylindrical tube of plastic film, said film being a multilayer film comprising at least two layers that have different melting points and where one layer comprises more than 50% of the film and has a melting point below 100° C., and at least one other layer has a melting point above 100° C., the cylindrical tube being in direct contact with a heat sink, sealing the adhesive filled cylinder and allowing the filled cylinder to cool.

16. The method of claim 15 wherein at least one layer of said multilayer film comprises a copolymer of ethylene or propylene with another comonomer.

17. The method of claim 15 wherein said one layer of said multi-layer film has a melting point of below 90° C.

18. The method of claim 16 wherein at least one layer of said multilayer film comprises a copolymer of ethylene with from about 10% to about 45% methyl acrylate, n-butyl acrylate or vinyl acetate comonomers.

19. The method of claim 18 wherein said one layer of said multi-layer film comprises ethylene methyl acrylate.

20. The method of claim 18 wherein said at least one other layer of said multi-layer film comprises ethylene vinyl acetate comonomer.

* * * * *